US005898417A

United States Patent [19]

Kanno et al.

[11] Patent Number: 5,898,417

[45] Date of Patent: Apr. 27, 1999

[54] DISPLAY APPARATUS AND DRIVING CIRCUIT

[75] Inventors: Hideo Kanno, Machida; Katsuhiro Miyamoto, Isehara, both of Japan

[73] Assignee: Canon Kabushiki Kaisha, Tokyo, Japan

[21] Appl. No.: 08/452,010

[22] Filed: May 26, 1995

Related U.S. Application Data

[63] Continuation-in-part of application No. 08/148,404, Nov. 8, 1993, abandoned, which is a continuation of application No. 07/684,209, Apr. 12, 1991, abandoned.

[30] Foreign Application Priority Data

Apr. 16, 1990 [JP] Japan ..... 2-100775

[51] Int. Cl.[6] ..... G09G 3/36

[52] U.S. Cl. ..... 345/103; 345/94; 345/208

[58] Field of Search ..... 345/87, 94, 103, 345/208, 55, 58, 67; 359/54; 349/33, 54; 348/790, 792, 793

[56] References Cited

U.S. PATENT DOCUMENTS

| | | | |
|---|---|---|---|
| 4,367,924 | 1/1983 | Clark et al. | 350/334 |
| 4,709,995 | 12/1987 | Kuribayashi et al. . | |
| 4,724,433 | 2/1988 | Inoue et al. | 340/784 |
| 4,872,002 | 10/1989 | Stewart et al. | 340/784 |
| 4,962,376 | 10/1990 | Inoue et al. | 340/805 |
| 5,032,832 | 7/1991 | Clerc et al. | 345/94 |
| 5,034,735 | 7/1991 | Inoue et al. | 340/784 |
| 5,049,865 | 9/1991 | Nakamura et al. | 340/811 |

FOREIGN PATENT DOCUMENTS

| | | |
|---|---|---|
| 0256879 | 2/1988 | European Pat. Off. . |
| 0355693 | 2/1990 | European Pat. Off. . |
| 2569294 | 2/1986 | France . |

*Primary Examiner*—Dennis-Doon Chow

*Attorney, Agent, or Firm*—Fitzpatrick, Cella, Harper & Scinto

[57] ABSTRACT

There is provided a display apparatus comprising: a display panel having a display screen in which scan electrodes and information electrodes are arranged in a matrix shape; first driving circuit for driving the scan electrodes and for selecting the number of channels of an outputting operation to the scan electrodes; and second driving circuit for driving the information electrodes.

5 Claims, 11 Drawing Sheets

DISPLAY APPARATUS AND DRIVING CIRCUIT

This application is a continuation, of application Ser. No. 08/148,404 filed Nov. 8, 1993 now abandoned, which is a continuation of application Ser. No. 07/684,209, filed Apr. 12, 1991, now abandoned.

BACKGROUND OF THE INVENTION

1. Field of the Invention

The invention relates to display apparatus and, more particularly, to a display apparatus using a display panel having a memory performance such as a ferroelectric liquid crystal display panel.

2. Related Background Art

In a CRT (cathode ray tube) which forms an image by using a decay characteristic of a fluorescent material or a TN (twisted nematic) type LCD (liquid crystal device) which forms an image by using a transmission light amount characteristic according to an effective value of a driving voltage, it is necessary to keep a frame frequency as one picture plane forming frequency to predetermined value or more from a viewpoint of the display principle. Generally, it is held to 30 Hz or higher. The frame frequency can be expressed by an inverse number of the product of the number of scanning lines constructing a display section and a horizontal scan time to scan the scanning lines. In the present situation, an interlacing method (jumping scan of every other scanning lines) and a non-interlacing method (non-jumping scan) have been known as scanning methods. A pairing method, a simultaneous parallel scanning method whereby the screen is divided into a plurality of display areas and the areas are simultaneously scanned in parallel although such a method is limited to the LCD, and the like have been put into practical use as another methods. In the NTSC standard, there is used the interlacing method of two fields/frame having a frame frequency of 30 Hz, in which the horizontal scan time is set to about 63.5 μ sec and the number of scanning lines is set to about 480 (the number of effective display lines). In the case of the TN type LCD, there is used the non-interlacing method in which the number of scanning lines is set to a value within a range from 200 to 400 and the frame frequency is set to 30 Hz or higher. In the CRT, separately from the NTSC standard, the non-interlacing method of a frame frequency of about 40 to 60 Hz is also used and the number of scanning lines is set to a value within a range from about 200 to 1000.

The cases of driving the CRT and the TN type LCD each of which is constructed by 1920 pixels in the vertical direction (scanning lines) ×2560 pixels in the lateral direction (data lines) will now be considered. In the case of using the interlacing method of a frame frequency of 30 Hz, the horizontal scan time is equal to about 17.5 μsec and the horizontal dot clock frequency is equal to about 147 MHz (no consideration is made with respect to the horizontal blanking time in the CRT). In the case of the CRT, the horizontal dot clock frequency of 147 MHz needs a very high beam scanning speed and fairly exceeds the maximum electron beam modulating frequency of the electron gun in the present image receiving tube. Even if the electron beam is scanned at a speed of 17.5 μsec, a video image cannot be accurately displayed. In the case of the TN type LCD, the driving of 1920 scanning lines corresponds to a duty ratio of 1920. Such a duty ratio is fairly larger than the present maximum duty ratio of about 400, so that an image cannot be displayed. Therefore, when considering the case of driving by setting the horizontal scan time as an actual value, the frame frequency is smaller than 30 Hz, so that the scanning state is visually recognized or a flickering occurs and the display quality is remarkably deteriorated. As mentioned above, it is a present situation that there are limitations in the realization of a large screen and a high density of the CRT and the TN type LCD because the number of scanning lines cannot be increased due to the display principle and the limitation of the drive elements or the like.

In recent years, Clerk and Lagerwell have proposed a ferroelectric liquid crystal device having a high response speed and a memory performance (bistability) by U.S. Pat. Ser. No. 4,367,924 or the like.

The ferroelectric liquid crystal device generally has a Chiral smectic C phase (SmC*) or H phase (SmH*) in a special temperature range. In this state, the ferroelectric temperature range. In this state, the ferroelectric liquid crystal device is set into either one of the first and second optical stable states in response to an electric field which is applied and has a characteristic, namely, a bistability such that the state is maintained when no electric field is applied. In addition, a response speed for a change in electric field is also high. Therefore, a wide use of such a device is expected as a high speed display device of the memory type.

However, generally, it is difficult that the ferroelectric liquid crystal device has the bistability as proposed by Clerk et al. and there is a large tendency such that the device has a monostable state. To realize the permanent bistability, Clerk et al. have used an orientation control method by applying a shearing force by sharing or by applying a magnetic field or the like. However, a method whereby a uniaxial orientation process such as rubbing process, oblique evaporation depositing process, or the like is executed to a substrate is advantageous as an orientation control method from a viewpoint of the production technique. There is a case where a permanent bistability is not obtained in the ferroelectric liquid crystal device whose orientation has been controlled by executing such a uniaxial orientation process to the substrate. The orientation state such that the permanent bistability doesn't occur, that is, what is called a monostable orientation state has a nature such that a biaxial orientation when the electric field has been applied is changed to the uniaxial orientation within a range from a few msec to several hours when no electric field is applied. Therefore, the display apparatus using the monostable ferroelectric liquid crystal device has a problem such that the image which has once been written is extinguished by cancelling the supply of the electric field. Particularly, upon multiplexing driving, there is a problem such that the writing states of the pixels on the scanning lines which are not accessed are gradually extinguished.

Therefore, to solve the above problem, there is considered a driving method (refreshing drive) whereby a voltage signal to cause "black" in the pixels on the selected scanning line and a voltage signal to cause "white" are selectively applied and, when it is assumed that a period to sequentially select the scanning lines is set to one frame or a plurality of fields, by repeating such a period, the writing process is executed. By using such a refreshing driving method, a fluctuation of the transmission light amount of the non-selected pixel is very small. Moreover, even at a frame frequency lower than 30 Hz, the visual recognition of the writing scanning line (phenomenon such that the scan writing line has a luminance higher than those of the other lines and can be also visually easily discriminated) and the occurrence of the flickering can be eliminated. In this case, by the examinations by the inventors of the present invention, it could be confirmed that a similar effect can be obtained even at a frame frequency of about 5 Hz.

The above fact is effective to solve in a lump the problems in the realization of a large screen and a high precision which occur from the inevitable condition such that the device must be driven at a frame frequency of 30 Hz or higher as a limit frequency in the CRT and then TN type LCD mentioned above.

However, in the case of refresh-driving at such a low frame frequency as mentioned above, there is a problem such that a processing speed at such a low frequency is slow for what is called a moving image display such as smooth scroll, cursor movement, or the like upon character edition or on a graphic screen, or the like and the display performance is deteriorated. In recent years, the developments of computers, peripheral circuits, and a software are remarkable. Particularly, for the display of a large screen and a high precision, a display method called a multi-window in which a plurality of screens are overlappingly displayed in the display area has widely been used. The display apparatus using the ferroelectric liquid crystal device can realize a large screen and a high precision which are extremely superior to those of the conventional display apparatuses (CRT, TN type LCD, and the like). However, there is a problem such that the frame frequency becomes low in association with the realization of the large screen and high precision, so that the speeds of the smooth scroll and the cursor movement become more and more slow.

SUMMARY OF THE INVENTION

It is an object of the invention to provide a driving apparatus of a display panel which can solve the foregoing problems.

Another object of the invention is to provide a driving apparatus of a display panel in which a moving image can be displayed at a high speed upon cursor movement or mouse movement in the scan driving at a low frame frequency of 30 Hz or lower.

According to the invention, there is provided a display apparatus comprising: a display panel having a display screen in which scan electrodes and information electrodes are arranged in a matrix shape; first driving means having means for driving the scan electrodes and selecting the number of output operation channels to the scan electrodes; and second driving means having means for driving the information electrodes.

DETAILED DESCRIPTION OF THE PREFERRED EMBODIMENT

Construction of display apparatus

Figure 1:
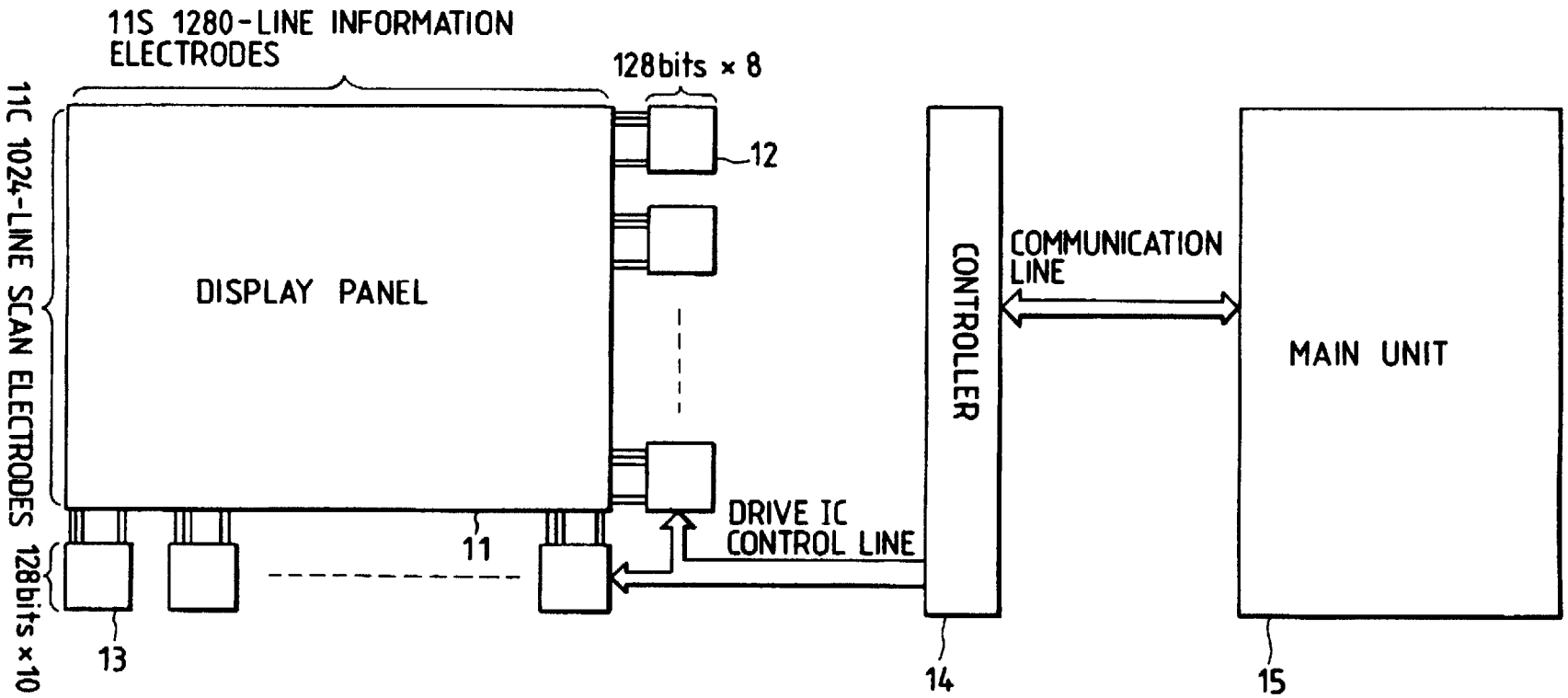
FIG. 1 is a block diagram showing an apparatus of the invention.

FIG. 1 is a constructional diagram of a display apparatus. A display panel 11 has a matrix structure comprising 1024 scan electrodes 11C and 1280 information electrodes 11S. A ferroelectric liquid crystal (Chiral smectic liquid crystal) is sealed in the display panel 11. Eight scan electrode drive ICs 12 each having an output of 128 bits and ten information electrode drive ICs 13 each having an output of 128 bits are connected to the scan electrodes 11C and information electrodes 11S, respectively. A controller 14 controls the scan electrode drive ICs 12 and information electrode drive ICs 13 and communicates with a main unit 15 to supply video data, respectively.

Block diagram of scan electrode drive IC

Figure 2:
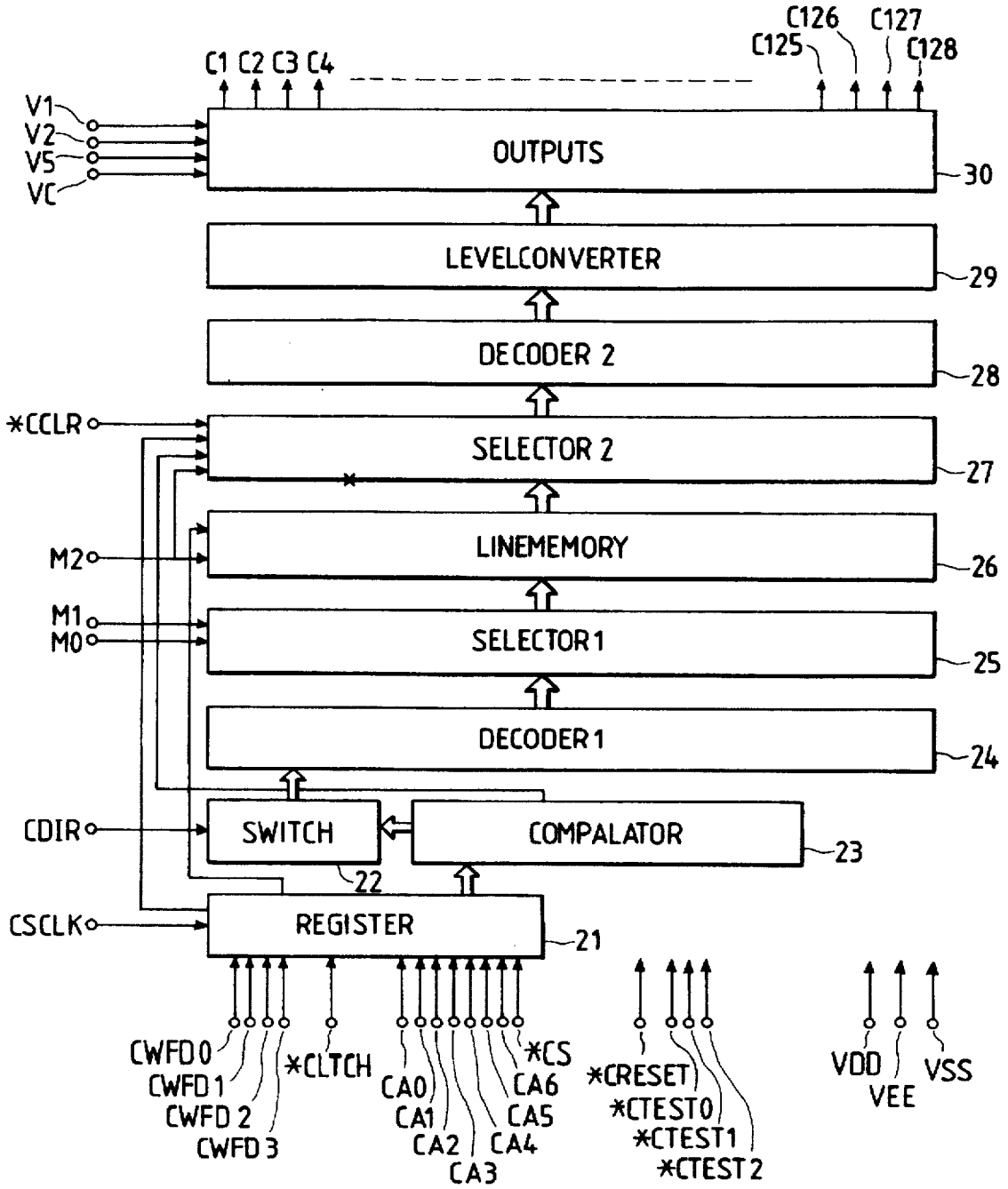
FIG. 2 is a block diagram of a scan electrode drive IC used in the invention.

FIG. 2 is a block diagram of the scan electrode drive IC. The functions of the blocks will now be described hereinbelow.

A register 21 samples input signals $CA_0$ to $CA_6$, *CS, $CWFD_0$ to $CWFD_3$, and *CLTCH by sampling clocks CSCLK and adjusts a timing variation among the signals.

A switch 22 converts the input signals $CA_0$ to $CA_6$ by a direction signal CDIR into the inversion/non-inversion data and switches the correspondence between address data (output circuit selection signals) which are designated by the signals $CA_0$ to $CA_6$ and output channels (output circuits).

A comparator 23 holds address data ($CA_0$ to $CA_6$, *CS) and compares with address data which is subsequently input, thereby setting a control state which is peculiar when the same output channel is selected.

A decoder-1 24 selects the output channel which is designated by the address data.

A selector-1 25 selects a selecting mode of the output channel (single mode=one channel is selected; dual mode= two adjacent channels are selected; quad (i.e., quadruple)= four adjacent channels are selected).

A line memory 26 stores output data of the selector-1 25.

A selector-2 27 selects either ones of the output waveform set data $CWFD_0$ and $CWFD_1$ of the output channels which are selected by the decoder-1 24 and output waveform set data $CWFD_2$ and $CWFD_3$ of the output channels which are selected by the line memory 26.

A decoder-2 28 generates levels of four values ($V_1$, $V_2$, $V_5$, VC) per one output channel and selects either one of the four values.

A level converter 29 converts a control signal which is generated by a digital circuit section of each of the above blocks into a voltage level for an output circuit.

Reference numeral 30 denotes an output circuit to generate liquid crystal driving waveforms of the levels of four values ($V_1$, $V_2$, $V_5$, VC).

Functions of terminals of scan electrode drive IC

Input/output terminals of the scan electrode drive IC in FIG. 2 and their functions will now be described.

$M_0$, $M_1$, and $M_2$ denote mode setting signals to determine the selecting method and the scanning method. Total six kinds of modes are set by a combination of them. Table 1 shows a truth table of them.(The selecting method and the scanning method will be described in the item of <input/output operation>, which will be explained hereinlater.)

TABLE 1

Mode set table

| $M^2$ | $M^1$ | $M^0$ | Scanning method | Selecting method |
|---|---|---|---|---|
| L | L | L | standard | single |
| L | L | H | standard | dual |
| L | H | L | standard | quad |
| L | H | H | standard | single |
| H | L | L | double | single |
| H | L | H | double | dual |
| H | H | L | double | quad |
| H | H | H | double | single |

$CWFD_0$ to $CWFD_3$ denote data signals of two sets/two bits for setting the four-value output waveforms of $V_1$, $V_2$, $V_5$, and VC. $CWFD_0$ and $CWFD_1$ denote the waveform set data for the output channels which are selected by the decoder-1 24. $CWFD_2$ and $CWFD_3$ denote the waveform set data for the output channels which are selected by the line memory 26. Table 2 shows a truth table of them.

TABLE 2

Output waveform set table

| Output voltage level set data which is selected by the line memory | | Output voltage level set data which is selected by the decoder-1 | | Output voltage |
|---|---|---|---|---|
| CWFD3 | CWFD2 | CWFD1 | CWFD0 | level |
| L | L | L | L | VC |
| L | H | L | H | V1 |
| H | L | H | L | V2 |
| H | H | H | H | V5 |

*CLTCH denotes a latch signal for taking the address data $CA_0$ to $CA_6$ and *CS and transferring an output of the decoder-1 24 to the line memory 26.

CSCLK denotes the sampling signal for sampling the address data $CA_0$ to $CA_6$ and *CS, the waveform set data $CWFD_0$ to $CWFD_3$, and the latch signal *CLTCH. A timing variation among the signals is corrected by the sampling signal CSCLK.

$CA_0$ to $CA_6$ denote address signals each for selecting one of 128 output channels.

*CS denotes a chip selection signal. The selection/non-selection of the output channels is decided by the products (AND) of the chip selection signal *CS and the address signals $CA_0$ to $CA_6$.

*CCLR denotes a signal to exclusively set an output of the output channel to the VC level irrespective of the states of the other logic input signals.

CDIR denotes the direction signal to switch the correspondence between the address data designated by $CA_0$ to $CA_6$ and the output channels to the forward direction/reverse direction. Table 3 shows a truth table of them. (H of 00H denotes a hexadecimal number. The selecting method will be explained in the term of <input/output operation>, which will be described hereinlater.)

TABLE 3

Correspondence table between the address data and the output channels

| CDIR | CAO–CA6 | Selecting method | Output channels |
|---|---|---|---|
| L | 00H→01H→ | Single | C1→C2→ |
| L | 00H→02H→ | Dual | C1 C2→C3 C4→ |
| L | 00H→04H→ | Quad | C1–C4→C5–C8→ |
| H | 00H→01H→ | Single | C128→C127→ |
| H | 01H→03H→ | Dual | C128 C127→C126 C125→ |
| H | 03H→07H→ | Quad | C128–C125→C124–C121→ |

*CRESET denotes a reset (initialization) signal to prevent the occurence of an unsteady state upon turn-on of the power in the logic circuit. The above function is made operative simultaneously with the power-on and all of the output channels are set to the VC level. After the power-on, the reset state can be also obtained by the reset signal *CRESET. Table 4 shows a truth table of them.

TABLE 4

Reset operation table

| *CRESET | Operating state |
|---|---|
| L | Reset state (VC output) |
| H | Control state by the other logic signals |

$*CTEST_0$ to $*CTEST_2$ denote signals to set an ordinary operating state and a test mode. The ordinary operating state is a state in which the IC can be controlled by the foregoing logic signal. The test mode is a state in which the other three values excluding the VC level can be preferentially set to all of the output channels than the other logic input signals. Table 5 shows a truth table of them.

TABLE 5

Operating mode table

| *CTEST2 | *CTEST1 | *CTEST0 | Operating mode |
|---|---|---|---|
| H | H | H | Ordinary operating state |
| H | H | L | Test mode, all channels V1 output |
| H | L | H | Test mode, all channels V5 output |
| H | L | L | Test mode, all channels V2 output |
| L | X | X | Test mode (note 1) |

(Note 1)
The set values by $CWFD_0$ and $CWFD_1$ are output to all of the channels.

$V_1$, $V_2$, $V_5$, and VC denote input terminals of a liquid crystal driving power source of four values.

VDD denotes a power source input for a logic circuit section.

VEE denotes a power source input for an output channel circuit section.

Vss denotes a GND (ground) terminal.

$C_1$, to $C_{128}$ denote liquid crystal drive output channels of 128 channels.

Input/output operation of scan electrode drive IC

A combination of the scanning method and the selecting method is set by the mode setting signals $M_0$ to $M_2$. In the embodiment, total six kinds of input/output operations can be set.

The input/output operations will now be described hereinbelow.

(1) Standard scanning method/single selection

In this input/output operation, one output channel is selected by one address data (single selection). In one horizontal scan period (hereinafter, referred to as 1H for the selected output channel), the selection period of one channel doesn't overlap the selection periods of the other output channels (standard scan).

Figure 3:
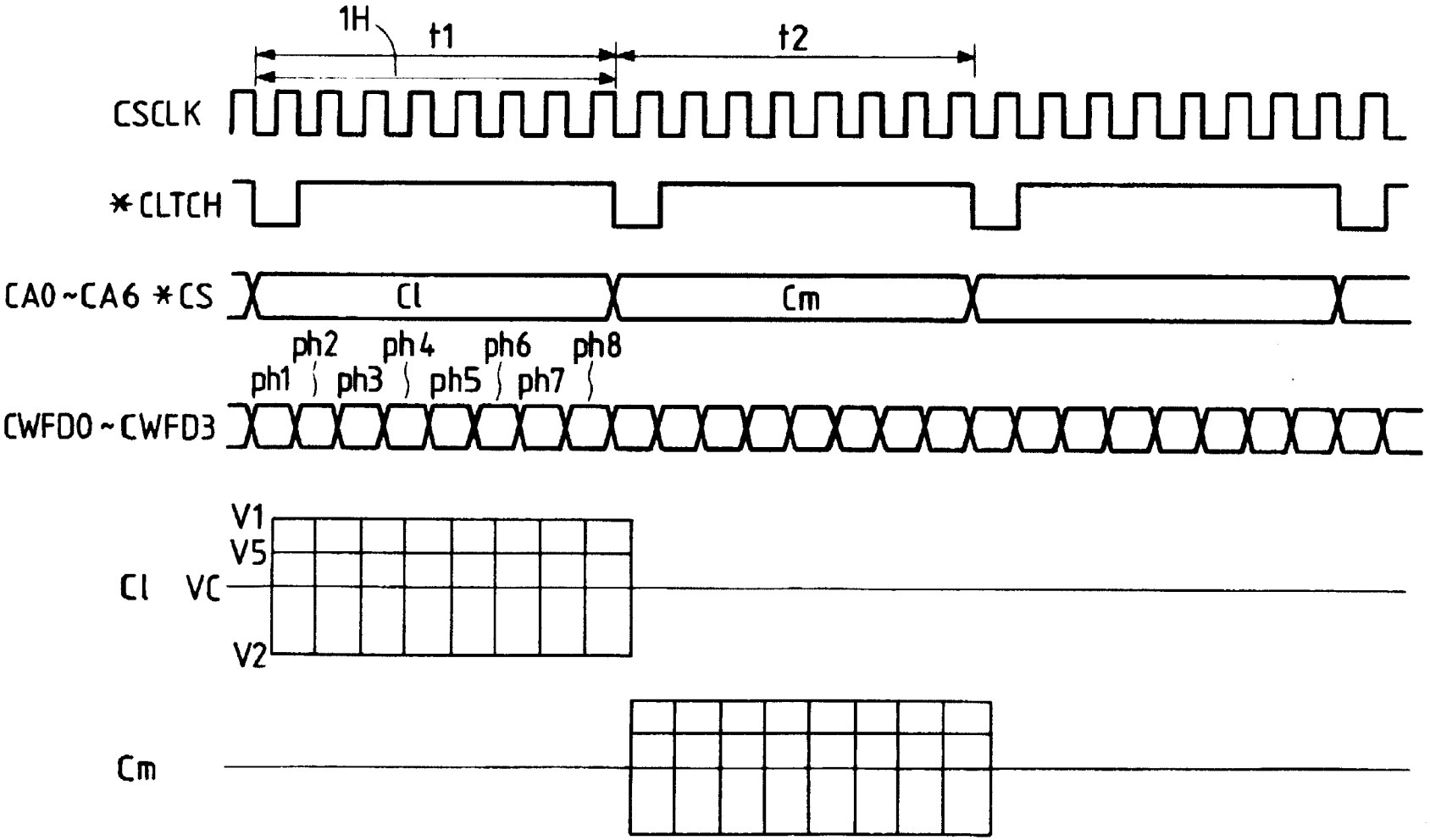
FIG. 3 is a timing chart showing the standard scan/single selection used in the invention.

FIG. 3 shows a timing chart of the above input/output operation.

A period of the latch signal *CLTCH is set to 1H. The signals $CA_0$ to $CA_6$ and *CS are switched syncronously with the *CLTCH. The signals $CWFD_0$ to $CWFD_3$ are switched at a period which is ⅛ of the period of 1H and are repeated every 1H synchronously with *CLTCH by a construction of eight cycles ($ph_1$ to $ph_8$) per 1H. The signal CSCLK functions as a fundamental clock of those input signals. The input signals are switched synchronously with the trailing edge of the signal CSCLK.

By inputting the input signals as mentioned above, the scan electrode drive IC first selects the output channel $C_1$ in a $t_1$ section and generates an output voltage level which is set by the $CWFD_0$ and $CWFD_1$. In the next 1H ($t_2$ section), since the address data has been switched to $C_m$ synchronously with the *CLTCH, an output channel $C_m$ is selected and an output voltage level which is set by $CWFD_0$ and $CWFD_1$ is generated. On the other hand, the output channel $C_1$ is set into a non-selecting state and the VC level is generated.

(2) Standard scan/dual selection

In this input/output operation, two adjacent output channels are selected by one address data (dual selection). The selection period of two channels is set to 1H. In the period of 1H, the selection period of the selected output channels doesn't overlap the selection period of the other output channels (standard scan).

There is the following relation between two adjacent channels. When CDIR=L level, the address data is certainly set to an even value ($CA_0$=L level) and the output channel of the number of "even value +1" is selected simultaneously with it. When CDIR=H level, the address data is certainly set to an odd value ($CA_0$=H level) and the output channel of the number of "odd value +1" is selected simultaneously with it. (dual selection)

Figure 4:
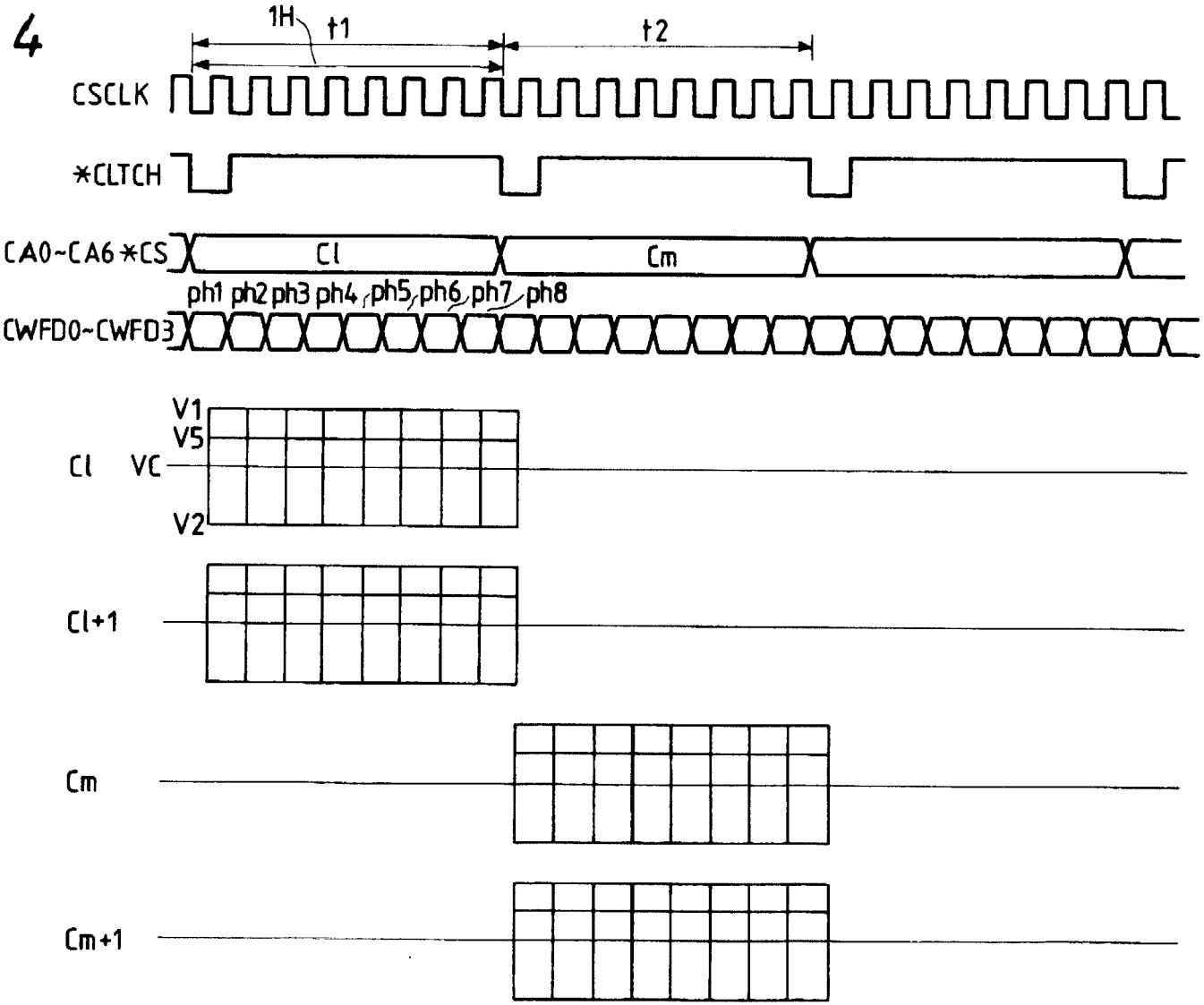
FIG. 4 is a timing chart showing the standard scan/dual selection used in the invention.

FIG. 4 shows a timing chart of the input/output operations. A period of *CLTCH is set to 1H. The signals $CA_0$ to $CA_6$ and *CS are switched synchronously with the signal *CLTCH. $CWFD_0$ and $CWFD_1$ are switched at a period of ⅛ of the period of 1H and are repeated every 1H synchronously with the signal *CLTCH by a construction of eight cycles ($ph_1$ to $ph_8$) per 1H. The signal CSCLK functions as a fundamental clock of those input signals. The input signals are switched synchronously with the trailing edge of the CSCLK.

When CDIR=L level, by inputting the input signals as mentioned above, the scan electrode drive IC first selects the output channel $C_1$ in the $t_1$ section and generates the output voltage level which is set by the signals $CWFD_0$ and $CWFD_1$ to the output channels $C_1$ and $C_{1+1}$. In the next 1H ($t_2$ section), since the address data has been switched to $C_m$ synchronously with the signal *CLTCH, the output channel $C_m$ is selected and the output voltage level which is set by the signals $CWFD_0$ and $CWFD_1$ is generated to the output channels $C_m$ and $C_{m+1}$. On the other hand, the output channels $C_1$ and $C_{1+1}$ are set into the non-selecting state and the VC level is generated.

(3) Standard scan/quad selection

In this input/output operation, four adjacent output channels are selected by one address data (quad selection). The selection period of four channels is set to 1H. The selection period of the selected output channels doesn't overlap the selection period of the other output channels in the period of 1H (standard scan). Four adjacent channels have the following relation. When CDIR=L level, the address data is certainly set to an even value ($CA_0$ and $CA_1$=L level). The output channels of the numbers of "even value +1", "even value +2", and "even value +3" are selected simultaneously with it. When CDIR=H level, the address data is certainly set to an odd value ($CA_0$ and $CA_1$=H level). The output channels of the numbers of "odd value +1", "odd value +2", and "odd value +3" are selected simultaneously with it. (quad selection)

Figure 5:
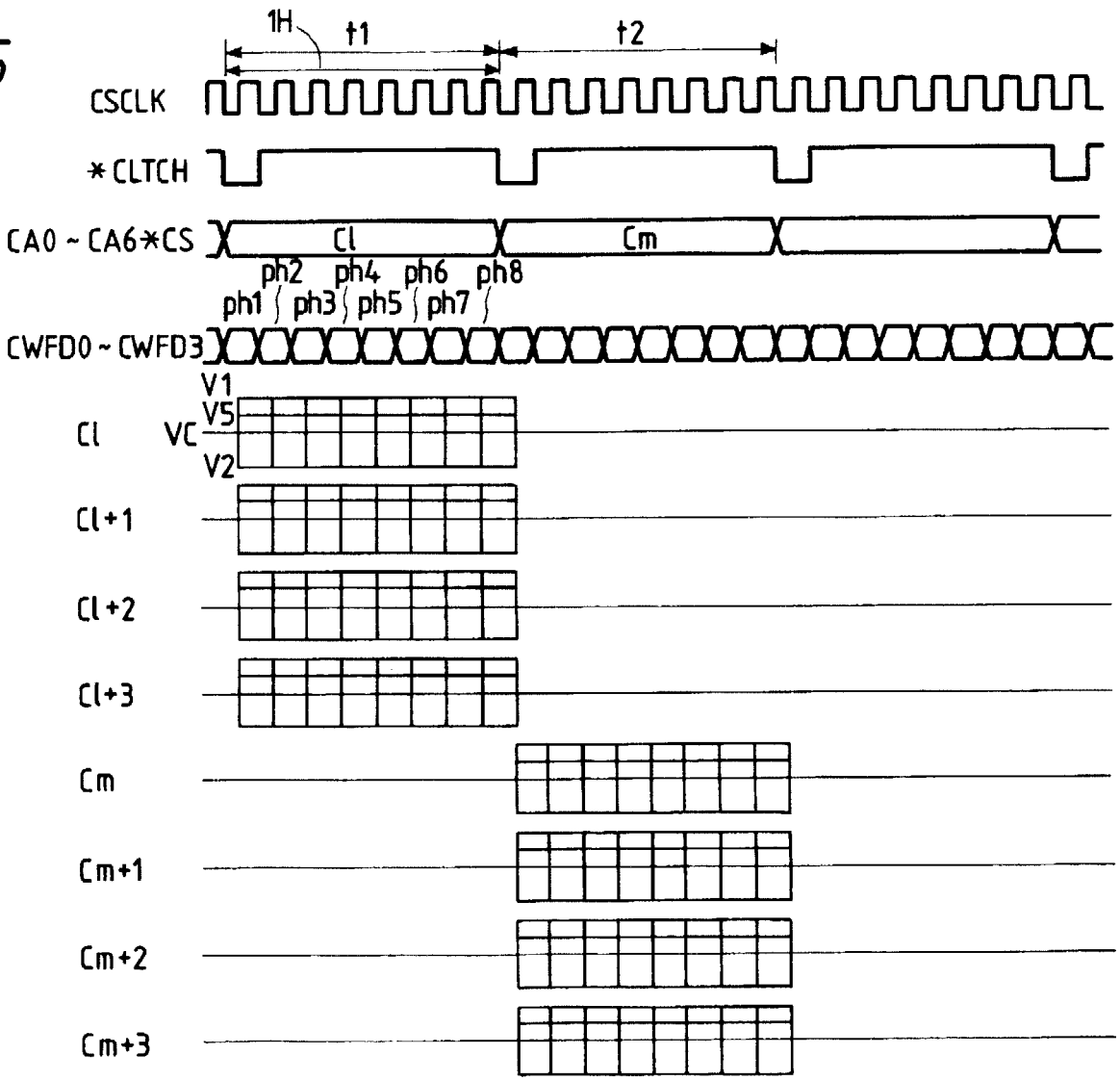
FIG. 5 is a timing chart showing the standard scan/quad selection used in the invention.

FIG. 5 shows a timing chart of the input/output operation. The period of the signal *CLTCH is set to 1H. The signals $CA_0$ to $CA_6$ and *CS are switched synchronously with the signal *CLTCH. The signals $CWFD_0$ and $CWFD_1$ are switched at a period of ⅛ of the period of 1H and are repeated every 1H synchronously with the signal *CLTCH by the construction of eight cycles ($ph_1$ to $ph_8$) per 1H. The signal CSCLK functions as a fundamental clock of the input signals. The input signals are switched synchronously with the trailing edge of the signal CSCLK.

When CDIR=L level, by inputting the input signals as mentioned above, the scan electrode drive IC first selects the output channel $C_1$ in the $t_1$ section and generates the output voltage level which is set by the signals $CWFD_0$ and $CWFD_1$ to the output channels $C_1$, $C_{1+1}$, $C_{1+2}$, and $C_{1+3}$. In the next 1H ($t_2$ section), since the address data has been switched to $C_m$ synchronously with the signal *CLTCH, the output channel $C_m$ is selected and the output voltage level which is set by the signals $CWFD_0$ and $CWFD_1$ is generated to the output channels $C_m$, $C_{m+1}$, $C_{m+2}$, and $C_{m+3}$. On the other hand, the output channels $C_1$, $C_{1+2}$, and $C_{1+3}$ are set into the non-selecting state and the VC level is generated.

1(4) Double scan/single selection

In this input/output operation, one output channel is selected by one address data (single selection) and the selection period of one channel is set to two continuous horizontal scan periods (hereinafter, referred to as 2H). The latter half period 1H of the 2H period overlaps the selection period of the output channel which is selected by the next address data (double scan).

Figure 6:
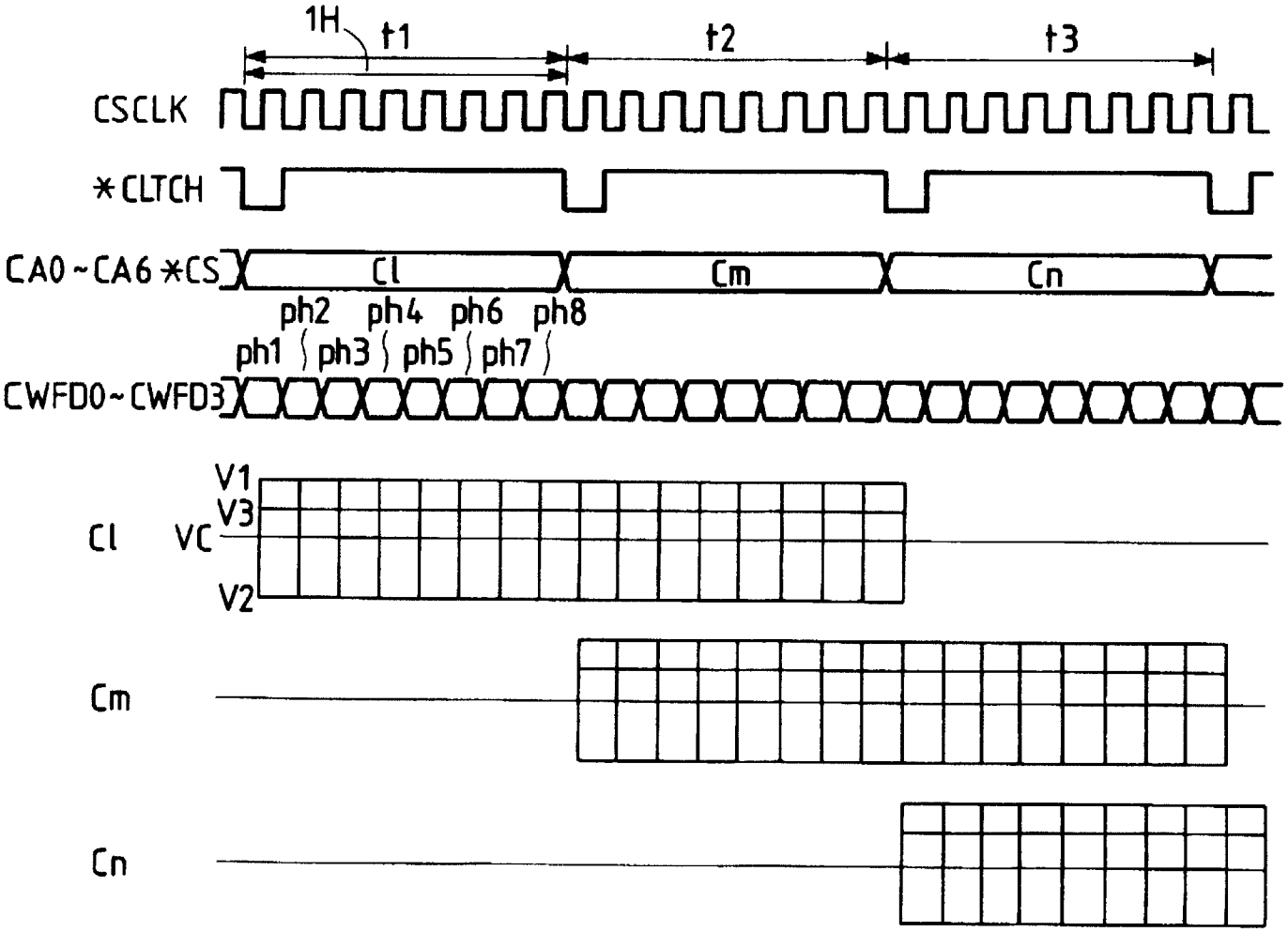
FIG. 6 is a timing chart showing the double scan/single selection used in the invention.

FIG. 6 shows a timing chart of the input/output operation. The period of the signal *CLTCH is set to 1H. The signals $CA_0$ to $CA_6$ and *CS are switched synchronously with the signal *CLTCH. The signals $CWFD_0$ to $CWFD_3$ are switched at a period of ⅛ of the period of 1H and are repeated every 1H synchronously with the signal *CLTCH by the construction of eight cycles ($ph_1$ to $ph_8$) per 1H. The signal CSCLK functions as a fundamental clock of the input signals. The input signals are switched synchronously with the trailing edge of the CSCLK. By inputting the input signals as mentioned above, the scan electrode drive IC first selects the output channel $C_1$ in the $t_1$ section and generates the output voltage level which is set by the signals $CWFD_0$ and $CWFD_1$ to the output channel $C_1$. In the next 1H ($t_2$ section), the address data is switched to $C_m$ synchronously with the signal *CLTCH, the output channel $C_m$ is selected, and the output voltage level which is set by the signals $CWFD_0$ and $CWFD_1$ is generated to the output channel $C_m$. On the other hand, in the $t_2$ section as well, the output channel $C_1$ is selected subsequently to the $t_2$ section and the output voltage level which is set by the signals $CWFD_2$ and $CWFD_3$ is generated to the output channel $C_1$. Further, in the next 1H ($t_3$ section), the address data is switched to $C_n$ synchronously with the signal *CLTCH, the output channel $C_n$ is selected, and the output voltage level which is set by the signals $CWFD_0$ and $CWFD_1$ is generated to the output channel $C_n$. In the $t_3$ section, in a state in which the output channel $C_m$ has been selected subsequently to the $t_2$ section, the output voltage level which is set by the signals $CWFD_2$ and $CWFD_3$ is generated to the output channel $C_m$. Further, the output channel $C_1$ is set into the non-selecting state and the VC level is generated.

(5) Double scan/dual selection

In this input/output operation, two adjacent output channels are selected by one address data (dual selection). The selection period of two channels is set to continuous 2H period. In the 2H period of time, two adjacent channels have the following relation. When CDIR=L level, the address data is certainly set to an even value ($CA_0$=L level). The output channel of the number of "even value +1" is selected simultaneously with it. When CDIR=H level, the address data is certainly set to an odd value ($CA_0$=H level). The output channel of the number of "odd value +1" is selected simultaneously with it. The latter half 1H of the 2H period overlaps the selection period of two channels which are selected by the next address data (double scan).

Figure 7:
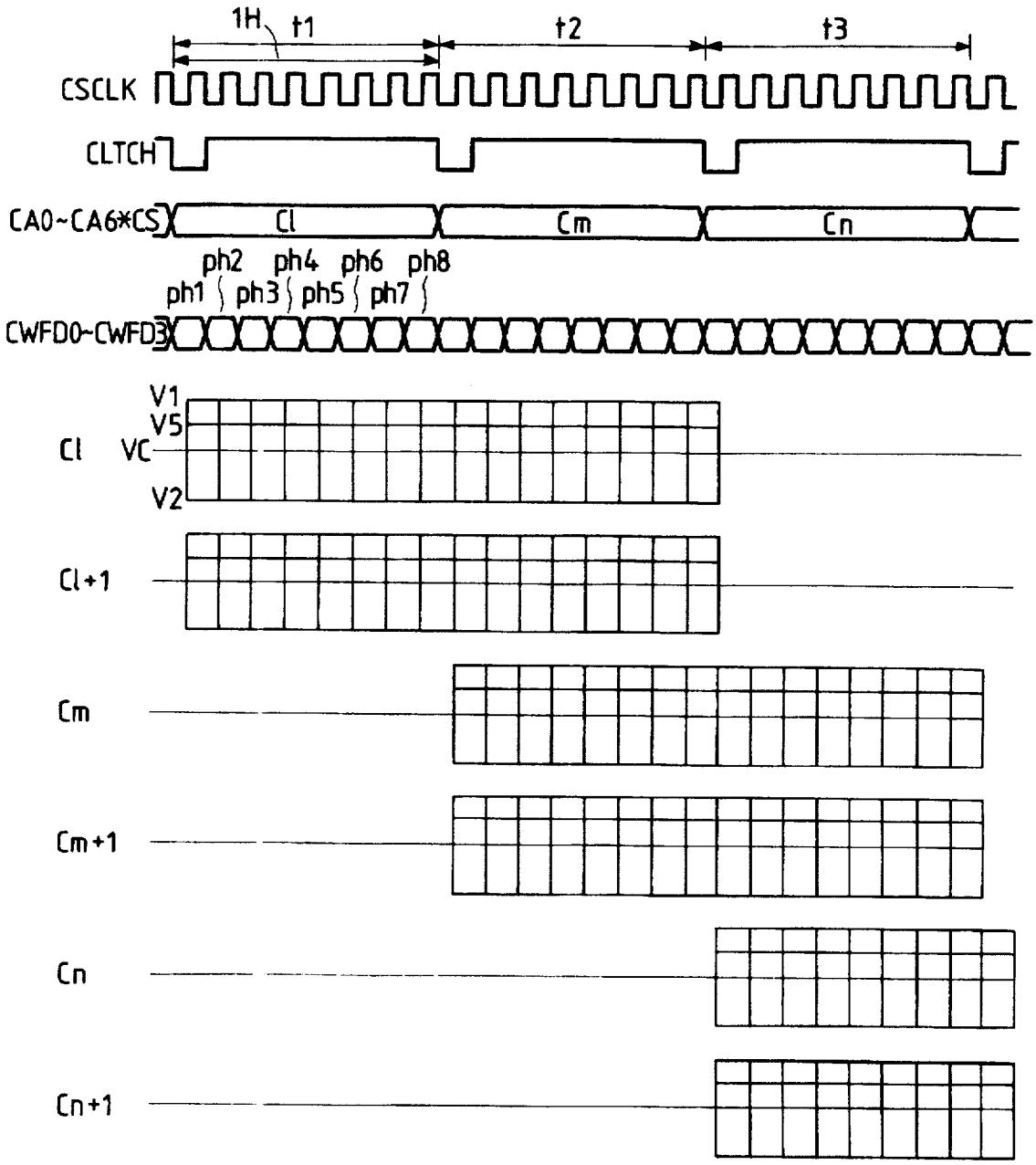
FIG. 7 is a timing chart showing the double scan/dual selection used in the invention.

FIG. 7 shows a timing chart of the input/output operation. The period of the signal *CLTCH is set to 1H. The signals $CA_0$ to $CA_6$ and *CS are switched synchronously with the signal *CLTCH. The signals $CWFD_0$ to $CWFD_3$ are switched at a period of ⅛ of the period of 1H and are repeated every 1H synchronously with the signal *CLTCH by the construction of eight cycles ($ph_1$ to $ph_8$) per 1H. The signal CSCLK functions as a fundamental clock of the input signals. The input signals are switched synchronously with the trailing edge of the signal CSCLK.

For instance, when CDIR=L level, by inputting the input signals as mentioned above, the scan electrode drive IC first selects the output channel $C_1$ in the $t_1$ section and generates the output voltage level which is set by the $CWFD_0$ and $CWFD_1$ to the output channels $C_1$ and $C_{1+1}$. In the next 1H ($t_2$ section), the address data is switched to $C_m$ synchronously with the signal *CLTCH, the output channel $C_m$ is selected, and the output voltage level which is set by the signals $CWFD_0$ and $CWFD_1$ is generated to the output channels $C_m$ and $C_{m+1}$. On the other hand, in the $t_2$ section as well, the output channels $C_1$ and $C_{1+1}$ have been selected subsequently to the $t_1$ section. The output voltage level which is set by the signals $CWFD_2$ and $CWFD_3$ is generated to the output channels $C_1$ and $C_{1+1}$. Further, in the next 1H ($t_3$ section), the address data is switched to $C_n$ synchronously with the signal *CLTCH, the output channel $C_n$ is selected, and the output voltage level which is set by the signals $CWFD_0$ and $CWFD_1$ is generated to the output channels $C_n$ and $C_{n+1}$. In the $t_3$ section, in a state in which the output channels $C_m$ and $C_{m+1}$ have been selected subsequently to the $t_2$ section, the output voltage level which is set by the signals $CWFD_2$ and $CWFD_3$ is generated to the output channels $C_m$ and $C_{m+1}$. Further, the output channels $C_1$ and $C_{1+1}$ are set into the non-selecting state and the VC level is generated.

(6) Double scan/quad selection

In this input/output operation, four continuous output channels are selected by one address data (quad selection) and the selection period of four channels is set to 2H. In the 2H period, four continuous channels have the following relation. When CDIR=L level, the address data is certainly set into an even value ($CA_0$ and $CA_1$=L level). The output channels of the numbers of "even value +1", "even value +2", and "even value +3" are selected simultaneously with it. When CDIR=H level, the address data is certainly set to an odd value ($CA_0$ and $CA_1$=H level). The output channels of the numbers of "odd value +1", "odd value +2", and "odd value +3" are selected simultaneously with it.

The latter half 1H of the 2H period overlaps the selection period of two channels which are selected by the next address data (double scan).

Figure 8:
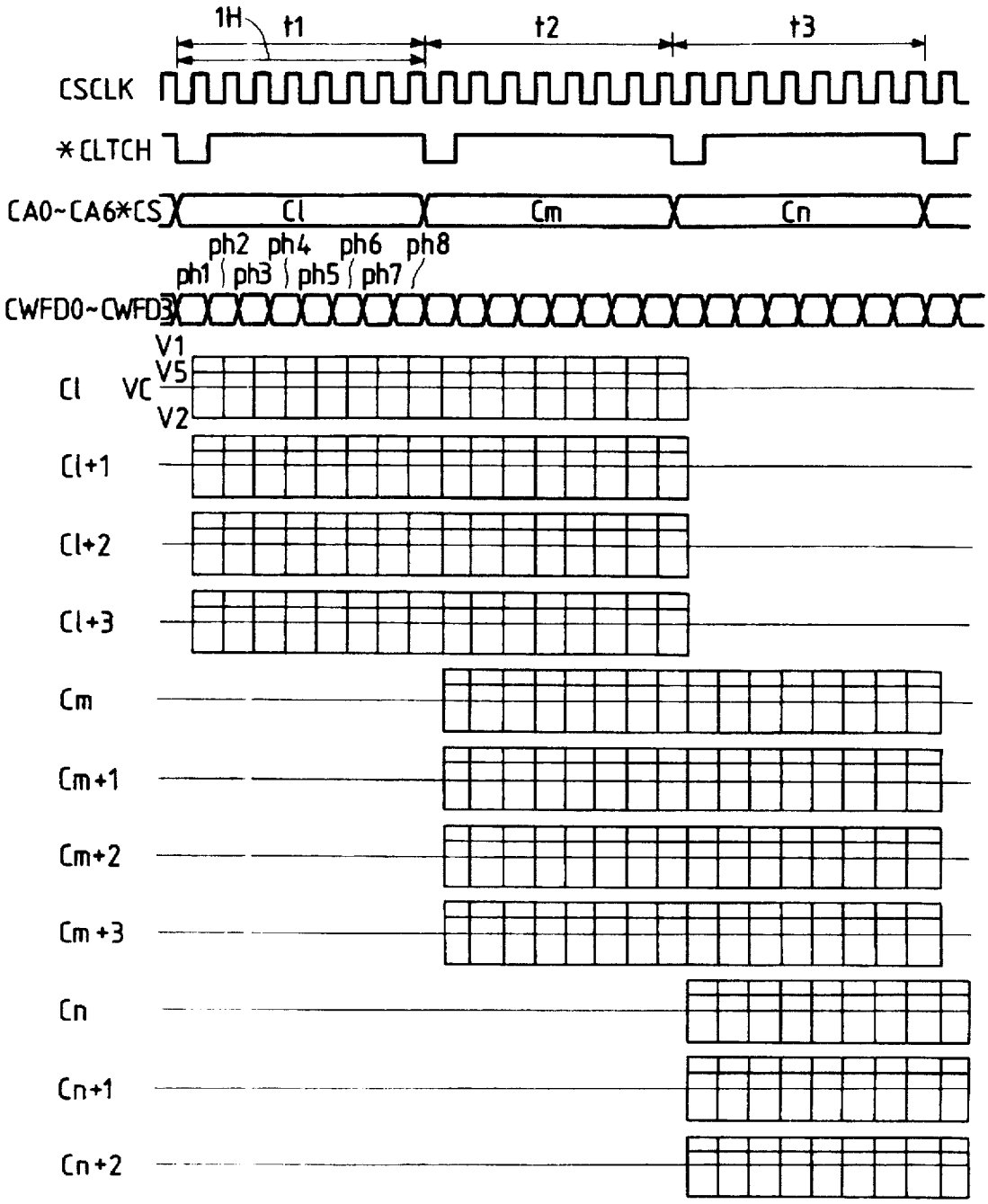
FIG. 8 is a timing chart showing the double scan/quad selection used in the invention.

FIG. 8 shows a timing chart of the input/output operations. The period of the signal *CLTCH is set to 1H. The signals $CA_0$ to $CA_6$ and *CS are switched synchronously with the signal *CLTCH. The signals $CWFD_0$ to $CWFD_3$ are repeated every 1H synchronously with the signal *CLTCH by the construction of eight cycles ($ph_1$ to $ph_8$) per 1H. The signal CSCLK functions as a fundamental clock of the input signals. The input signals are switched synchronously with the trailing edge of the signal CSCLK.

For instance, when CDIR=L level, by inputting the input signals as mentioned above, the scan electrode drive IC first selects the output channel $C_1$ in the $t_1$ section and generates the output voltage level which is set by the signals $CWFD_0$ and $CWFD_1$ to the output channels $C_1$, $C_{1+1}$, $C_{1+2}$, and $C_{1+3}$. In the next 1H ($t_2$ section), the address data is switched to $C_m$ synchronously with the signal *CLTCH, the output channel $C_m$ is selected, and the output voltage level which is set by the signals $CWFD_0$ and $CWFD_1$ is generated to the output channels $C_m$, $C_{m+1}$, $C_{m+2}$, and $C_{m+3}$. On the other hand, in the $t_2$ section as well, the output channels $C_1$, $C_{1+1}$, $C_{1+2}$ and $C_{1+3}$ have been selected subsequently to the $t_1$ section. The output voltage level which is set by the signals $CWFD_2$ and $CWFD_3$ is generated to the output channels $C_1$, $C_{1+1}$, $C_{1+2}$ and $C_{1+3}$. In the next 1H ($t_3$ section), the address data is switched to $C_n$ synchronously with the signal *CLTCH, the output channel $C_n$ is selected, and the output voltage level which is set by the signals $CWFD_0$ and $CWFD_1$ is generated to the output channels $C_n$, $C_{n+1}$, $C_{n+2}$, and $C_{n+3}$. In the $t_3$ section, in a state in which the output channels $C_m$, $C_{m+1}$, $C_{m+2}$, and $C_{m+3}$ have been selected subsequently from the $t_2$ section, the output voltage level which is set by the signals $CWFD_2$ and $CWFD_3$ is generated to the output channels $C_m$, $C_{m+1}$, $C_{m+2}$, and $C_{m+3}$. Further, the output channels $C_1$, $C_{1+1}$, $C_{1+2}$ and $C_{1+3}$ are set into the non-selecting state and the VC level is generated.

The operating speeds and the operating voltages in the embodiment in the above six operating modes are as follows.

| | | |
|---|---|---|
| CLCSLK = 160 kHz | *CLTCH = 20 kHz | |
| CA0~CA6, *CS = 10 Hz | CWFD0~CWFD3 = 89 kHz | |
| VEE = 40 V | VDD = 5 V | VSS = 0 V |
| V1 = 38 V | V2 = 2 V | V5 = 28.1 V | VC = 20 V |

Block diagram of information electrode drive IC

Figure 9:
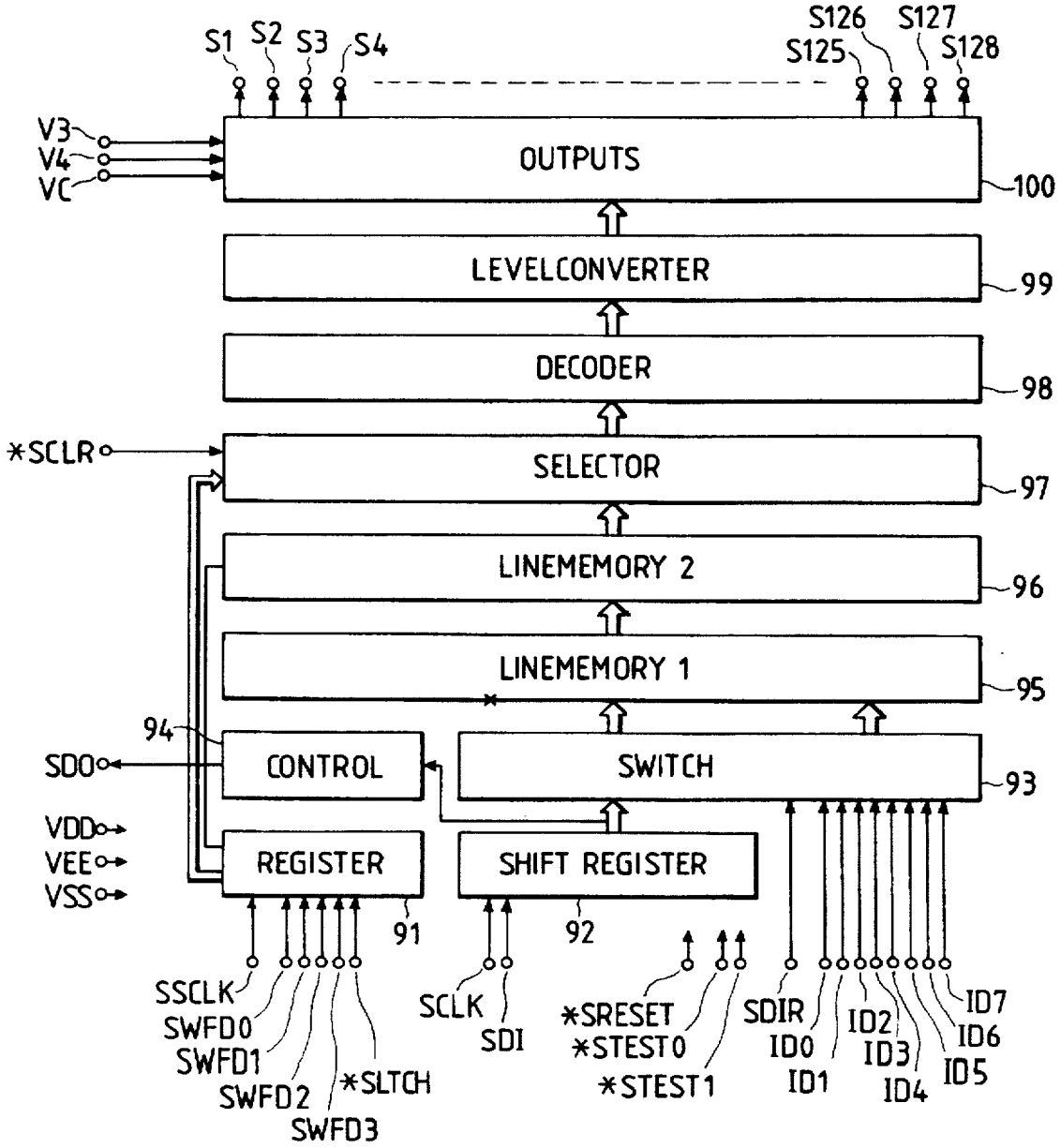
FIG. 9 is a block diagram of an information electrode drive IC used in the invention.

FIG. 9 is a block diagram of the information electrode drive IC. The functions of the blocks will now be described hereinbelow.

A register 91 samples input signals $SWFD_0$ to $SWFD_3$ and *SLTCH by a sampling clock signal SSCLK and adjusts a timing variation among the signals. A shift register 92 generates sampling clocks which are necessary to sample image data. A switch 93 switches the sampling order (left shift/right shift) of the image data.

A controller 94 controls the IC so as to be set into a state in which the image data can be sampled (enable state) or a state in which the image data cannot be sampled (disenable state).

A line memory-1 95 samples and holds 128 image data.

A line memory-2 96 stores an output of the line memory-1 95. A selector 97 selects either ones of the output waveform set data $SWFD_0$ and $SWFD_1$ when the image data stored in the line memory-2 96 is at the L level and the output waveform set data $SWFD_2$ and $SWFD_3$ when the image data is at the H level.

A decoder 98 generates levels of three values ($V_3$, $V_4$, VC) per one output channel and selects either one of them.

A level comparator 99 converts a voltage level of a control signal generated from a digital circuit section of each of the above blocks into a level for an output circuit.

Reference numeral 100 denotes an output circuit to generate liquid crystal drive waveforms of the levels of three values ($V_3$, $V_4$, VC).

Terminal functions of information electrode drive IC

Input and output terminals of the information electrode drive IC in FIG. 9 and their functions will now be described.

$ID_0$ to $ID_7$ denote 8-bit parallel image data signals.

SCLK denotes a transfer clock for image data signals $ID_0$ to $ID_7$ and is also a shift clock for the shift register 92.

SDI denotes a serial data input signal of the shift register 92.

SDO denotes a serial data output signal which has been generated from the shift register 92 and transmitted through a control circuit. When ICs are cascade-connected, the signal SDO is used as a cascade signal.

$SWFD_0$ to $SWFD_3$ denote data signals of two sets/2 bits to set out put waveforms of three values of $V_3$, $V_4$, and VC. $SWFD_0$ and $SWDF_1$ are used as signals to set the output voltage level when the image data is at the L level. $SWDF_2$ and $SWFD_3$ are used as signals to set the output voltage level when the image data is at the H level. Table 6 shows a truth table of them.

TABLE 6

Output waveform set table

| Output voltage level set data when image data is at the H level | | Output voltage level set data when image data is at the L level | | Output voltage |
|---|---|---|---|---|
| SWFD3 | SWFD2 | SWFD1 | SWFD0 | level |
| L | L | L | L | VC |
| L | H | L | H | V3 |
| H | L | H | L | V4 |
| H | H | H | H | X |

*SLTCH denotes a latch signal for transferring the image data which has been sampled by the line memory-1 95 into the line memory-2 96.

SSCLK denotes a sampling clock signal to sample the waveform set data $SWFD_0$ to $SWFD_3$ and *SLTCH. A timing variation among the signals is adjusted by the signal SSCLK.

SDIR denotes a signal to set the sampling order (left shift/right shift) of the image data, so that the correspondence between the image data and the output channel is decided by the signal SDIR. Table 7 shows the corresponding channel shift order.

(Explanation will be described further in detail in the term of the description of the input/output operations, which will be explained hereinlater.)

TABLE 7

Corresponding channel shift order

| SDIR | Corresponding channel shift order |
|---|---|
| L | S1 → S2 → S3 → . . . S128 |
| H | S128 → S127 → . . . S1 |

*SCLK denotes a signal to exclusively set an output of the output channel to the VC level irrespective of states of the other logic input signals.

SRESET denotes a signal to reset (initialization) to prevent the occurrence of an unsteady state upon power-on in the logic circuit. The above function is made operative simultaneously with the power-on and all of the output channels generate the VC level. After the power-on as well, the IC can be set to the reset state by the signal SRESET. Table 8 shows a truth table of them.

TABLE 8

Resetting operation table

| *SRESET | Operating state |
|---|---|
| L | VC output |
| H | Control state by the other logic signals |

*$STEST_0$ and $STEST_1$ denote signals to set the ordinary operating state and a test mode. In the ordinary operating state, the IC can be controlled by the above logic signal. In the test mode, the other two values excluding the VC level can be preferentially set for all of the output channels than the other logic input signals.

Table 9 shows a truth table of them.

TABLE 9

Operating mode table

| *STEST1 | *STEST2 | Operating mode |
|---|---|---|
| H | H | Ordinary operating state |
| H | L | Test mode, all channel V4 output |
| L | H | Test mode, all channel V3 output |
| L | L | Test mode, (note 1) |

(Note: 1)
Data of $ID_0$ to $ID_7$ are written every clock of SCLK and the set values of $SWFD_0$ to $SWFD_3$ are generated.

$V_3$, $V_4$, and VC denote input terminals of a liquid crystal driving power source of three values.

VDD denotes the power source input for a logic circuit section.

VEE denotes the power source input for an output channel circuit section.

VSS denotes the GND (ground) terminal.

$S_1$ to $S_{128}$ denote liquid crystal drive output channels of 128 channels.

Input/output operation of information electrode drive IC

The main operations of the IC are mainly classified into the sampling operation of the image data and the liquid crystal driving operation. The former is the high-speed operation and the latter is the low-speed operation. Both of the above operations are independently executed.

The input/output operations will now be described hereinbelow.

Figure 10:
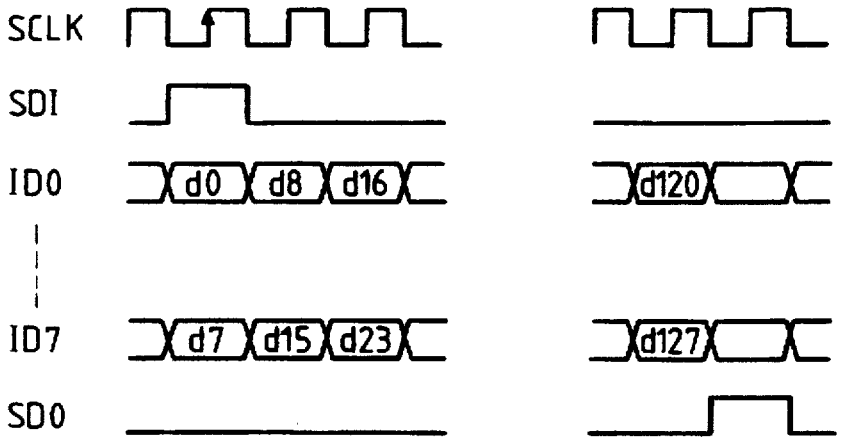
FIG. 10 is a timing chart showing the operation in an image data sampling period used in the invention.

FIG. 10 shows the operations in the image data sampling period of time. SDI denotes an H level pulse of an $SCLK_1$ period width which is synchronized with the trailing edge of the signal SCLK. The signals $ID_0$ to $ID_7$ are switched synchronously with the trailing edge of the signal SCLK. The heads ($d_1$ to $d_8$) of the image data are input at timings according to the H level pulses of SDI. The correspondences between the image data and the output channels are as shown in Table 10.

TABLE 10

Correspondence between the image data and the output channels

When SDIR = L level,
d1 d2 . . . d7 = S1 S2 . . . S7
.
.
d121 d122 . . . d128 = S121 S122 . . . S128
When SDIR = H level,
d1 d2 . . . d7 = S128 S127 . . . S121
.
.
d121 d122 . . . d128 = S8 S7 . . . S1

As a signal SDO, an H level pulse having a width of one period of the signal SCLK is generated after sixteen cycles of the signal SCLK for the H level pulse of SDI. When the ICs are cascade-connected, the SDO signal is connected to an SDI terminal of the IC at the next stage and is used as a cascade signal. Further in detail, when the SDI signal is input as mentioned above, the IC starts the sampling operation of the image data at this time point and continues the operation after completion of 16 cycles of the signal SCLK (after 128 image data were sampled). The operations of the circuits regarding the sampling of the image data (for instance, the shift register 92, controller 94, switch 93, line memory-1 95, etc.) are stopped just after the generation of the SDO signal.

Figure 11:
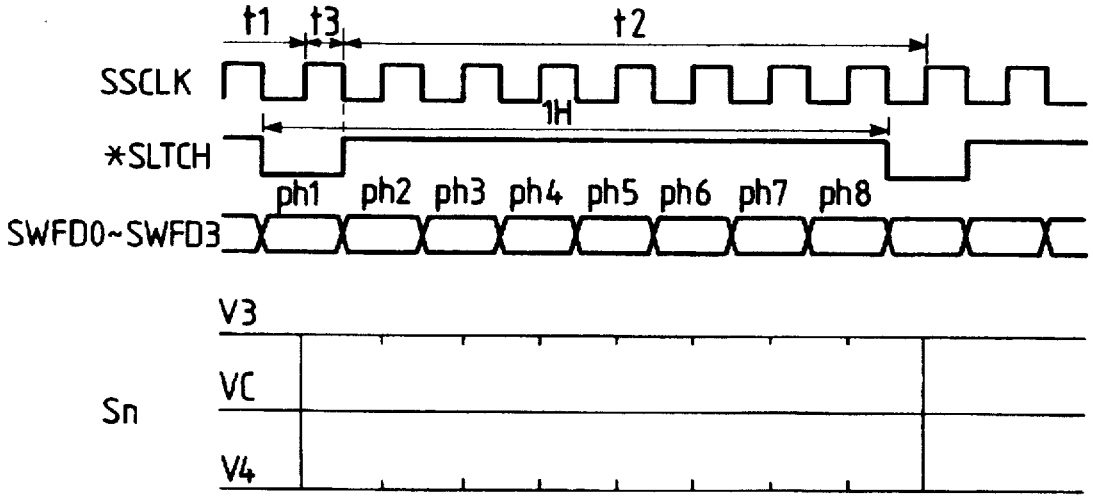
FIG. 11 is a liquid crystal drive output timing chart used in the invention.

FIG. 11 shows the operation of the liquid crystal drive output timings.

The period of the signal *SLTCH is set to one horizontal scan period (hereinafter, referred to as 1H). The L level of the signal *SLTCH is located after completion of the sampling operation of the image data. The signals $SWFD_0$ to $SWFD_3$ are switched at a period of ⅛ of the 1H period and are repeated every 1H synchronously with the signal *SLTCH by the construction of eight cycles ($ph_1$ to $ph_8$) per 1H. SSCLK denotes a fundamental block of the input signals. The input signals are switched synchronously with the trailing edge of the signal SSCLK.

The IC transfers the image data which has been sampled into the line memory-1 95 for the period of 1H before (in the $t_1$ section) to the line memory-2 96 for a period ($t_3$) of the leading portion of the signal *SLTCH from the leading portion of the signal SSCLK which rises at the level of the signal *SLTCH. When the image data is at the L level for the output channel $S_n$, the output voltage level which is set by the signals $SWFD_0$ and $SWFD_1$ is generated. When the image data is at the H level, the output voltage level which is set by the signals $SWFD_2$ and $SWFD_3$ is generated. The period during the above operation is set to a sampling period of time of the image data of the next 1H. Accurately speaking, it is a period of time ($t_2$ section) from the leading edge of the signal *SLTCH to the leading edge of the signal SSCLK in the next L level period of the signal *SLTCH.

The operating speeds and the operating voltages in the embodiment are as follows.

SSCLK = 160 kHz *SLTCH = 20 kHz
SWFD0~SWFD3 = 80 kHz SCLK = 10 MHz
ID0~ID7 = 5 MHz
VEE = 40 V VDD = 5 V VSS = 0 V
V3 = 27.4 V V4 = 12.6 V VC = 20 V

Figure 12:
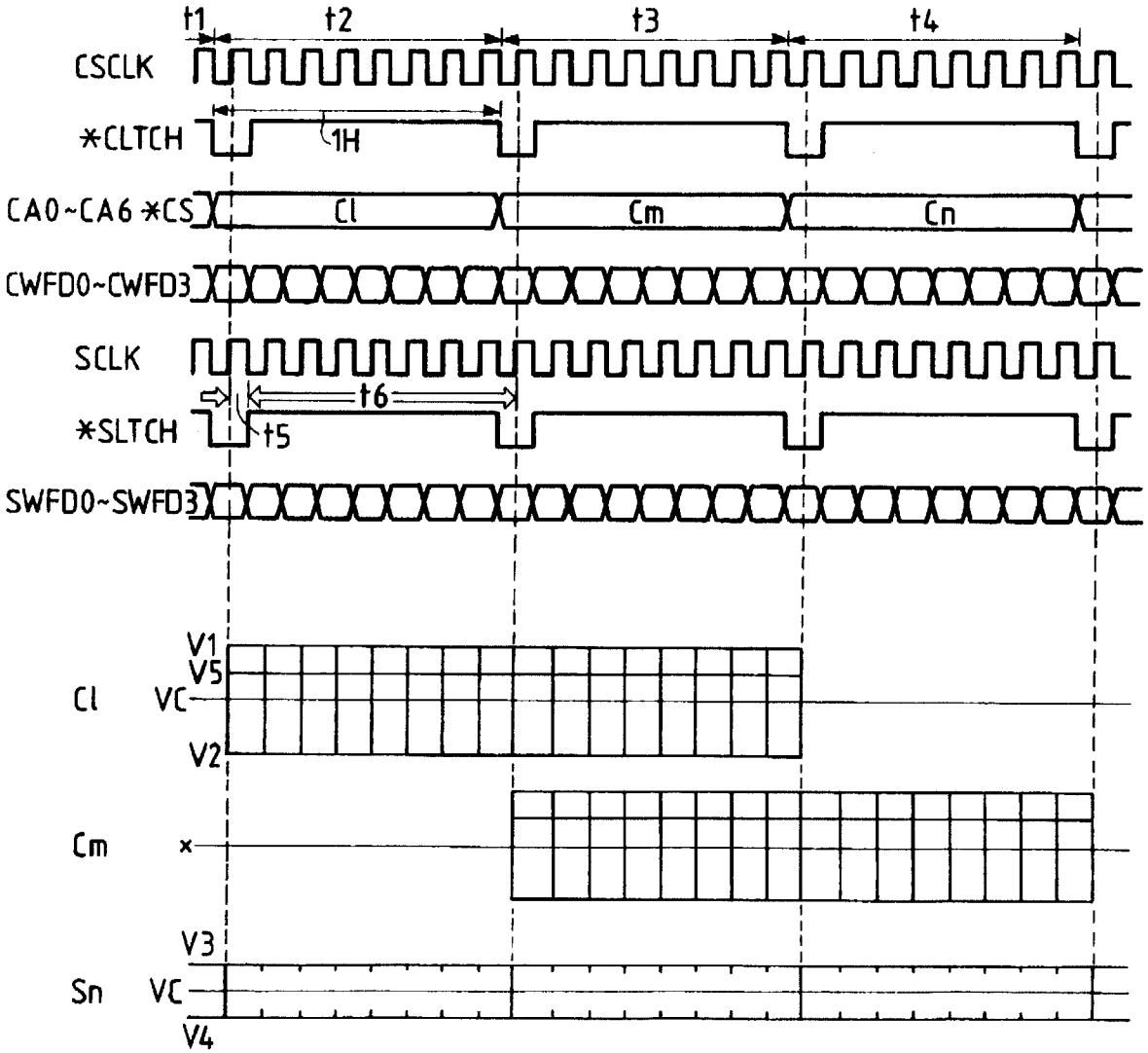
FIG. 12 is an operation timing chart for the scan electrode drive IC and the information electrode drive IC used in the invention.

Input/output timings of information eleotrode drive IC to scan electrode drive IC FIG. 12 shows an example of the operation timing relation between the scan electrode drive IC and the information electrode drive IC. The operating mode of the double scan/single selection will now be explained as an example. Input signals of both of the ICs are input as in the foregoing input/output operations. The input timing relation between both of the ICs is as follows. The signals CSCLK and SSCLK are set to the same phase. The signals *CLTCH and *SLTCH are set to the same phase. The signals $CWFD_0$ to $CWFD_3$ and the signals $SWFD_0$ to $SWFD_3$ are set to the same phase. Therefore, the output timing relation between both of the ICs is as follows. The synchronized output voltage levels are generated for the signals CSCLK and SSCLK or the signals *CLTCH and *SLTCH. By taking into consideration a combination of both of the ICs, the scan electrode drive IC first selects the output channel $C_1$ in the $t_2$ section and generates the output voltage level which is set by the signals $CWFD_0$ and $CWFD_1$ to the output channel $C_1$. On the other hand, the information electrode drive IC transfers the image data which has been sampled into the line memory-1 95 in the period of 1H before (in the $t_1$ section) to the line memory-2 96 for a period of time ($t_5$ section) of the leading portion of the signal *SLTCH from the leading portion of the signal SSCLK which rises in the L level portion of the signal *SLTCH. The output voltage level which is set by the relation between the image data and the signals $SWFD_0$ to $SWFD_3$ is generated (Sn).

At this time, the image data of the next 1H is also sampled ($t_6$ section). In the next 1H ($t_3$ section), the address data is switched to $C_m$, the output channel $C_m$ is selected, and the output voltage level which is set by the signals $CWFD_0$ and $CWFD_1$ is generated to the output channel $C_m$. The output channel $C_1$ has also been selected in the $t_3$ section subsequently to the $t_2$ section. The output voltage level which is set by the signals $CWFD_2$ and $CWFD_3$ is generated. On the other hand, the information electrode drive IC is updated with the image data which has been sampled in the period of 1H before (in the $t_2$ section) and repeats the operation similar to that in the $t_2$ section ($s_n$)

At this time, the image data of the next 1H is also sampled.

In the next 1H ($t_4$ section), the address data is switched to $C_n$, the output channel $C_n$ is selected, and the output voltage level which is set by the signals $CWFD_0$ and $CWFD_1$ is generated to the output channel $C_n$. The output channel $C_m$ has also been selected in the $t_4$ section subsequently and the output voltage level which is set by the signals $CWFD_2$ and $CWFD_3$ is generated. Further, the output channel $C_1$ is set into the non-selecting state and the VC level is generated.

On the other hand, the information electrode driving IC is updated to the image data which has been sampled in the period of 1H before (in the $t_3$ section) and repeats the operation similar to that in the $t_2$ section. ($s_n$)

By making both of the ICs operative at the timings as mentioned above, a desired drive waveform can be applied to the scan electrodes and the information electrodes.

The operating speeds and the operating voltages of the embodiment are as follows.

| | |
|---|---|
| * CSCLK = 160 kHz | * CLTCH = 20 kHz |
| CA0~CA6, *CS = 1.0 kHz | CWFD0~CWFD3 = 80 kHz |
| SSCLK = 160 kHz | * SLTCH = 20 kHz |
| SWFD0~SWFD3 = 80 kHz | SCLK = 10 MHz |
| ID0~ID7 = 5 MHz | |
| VEE =40 V | VDD = 5 V VSS = 0 V |
| V1 = 38 V V2 = 2 V | V3 = 27.4 V V4 = 12.6 V |
| V5 = 28.1 V | VC = 20 V |

According to the invention, compatibility between the partial rewriting drive and the total display screen scan drive can be realized and a speed of the partial moving image display at a low frame frequency can be made high.

What is claimed is:

1. A display apparatus, comprising:

a display panel having a display screen in which scan electrodes and information electrodes are arranged in a matrix, each of said scan electrodes constituting a channel;

first driving means for driving the scan electrodes;

second driving means for driving the information electrodes;

first changeover means for changing over between a first plurality of selecting methods, wherein in each selecting method a scanning signal is output concurrently from said first driving means to a respective different number of the channels within one horizontal scan period;

second changeover means for changing over between a second plurality of scanning methods, including a first scanning method in which a scanning signal is output from said first driving means to a preceding channel and a following channel such that a latter half of a first period during which the scanning signal is output to the preceding channel output overlaps a former half of a second period during which a scanning signal is output to the following channel, the second plurality of scanning methods further including a second scanning method in which a scanning signal is output from said first driving means to a preceding channel and a following channel such that a third period during which the scanning signal is output to the preceding channel and a fourth period during which the scanning signal is output to the following channel output do not overlap, wherein the latter half of the first period, the former half of the second period, the third period and the fourth period are all equal to each other in duration; and control means for controlling operations of both said first changeover means and said second changeover means to select one of a third plurality of operation modes of said display apparatus, wherein each operation mode consists of one of the first plurality of selecting methods operating concurrently with one of the second plurality of scanning methods.

2. A display apparatus according to claim 1, wherein said first driving means includes means for allocating addresses to the channels, said first driving means outputting scanning signals to the channels in accordance with the allocated addresses on the basis of an address allocation signal.

3. A display apparatus according to claim 1, wherein said display panel is a liquid crystal display panel.

4. A display apparatus according to claim 3, wherein said liquid crystal display panel includes a chiral smectic liquid crystal.

5. A display apparatus according to claim 1, wherein the first plurality of selecting methods includes a first selecting method in which the respective number of channels is 1, a second selecting method in which the respective number of channels is 2, and a third selecting method in which the respective number of channels is 4.

* * * * *

UNITED STATES PATENT AND TRADEMARK OFFICE

CERTIFICATE OF CORRECTION

PATENT NO. : 5,898,417

DATED : April 27, 1999

INVENTOR(S): HIDEO KANNO, ET AL.

It is certified that error appears in the above-identified patent and that said Letters Patent is hereby corrected as shown below:

On the title page:

AT [63], RELATED U.S. APPLICATION DATA

"Continuation-in-part" should read --Continuation--.

AT SHEET 2, FIGURE 2

"COMPALATOR" should read --COMPARATOR--.

COLUMN 1

Line 4, "continuation," should read --continuation--.
Line 5, "1993" should read --1993,--.
Line 29, "lines)" should read --line)--.
Line 38, "$\mu$ sec" should read --$\mu$sec--.

COLUMN 2

Line 14, "Chiral" should read --chiral--.
Line 15, "In this state, the ferroelectric" should be deleted.
Line 16, "temperature range." should be deleted.
Line 38, "doesn't" should read --does not--.

UNITED STATES PATENT AND TRADEMARK OFFICE

CERTIFICATE OF CORRECTION

PATENT NO. : 5,898,417

DATED : April 27, 1999

INVENTOR(S): HIDEO KANNO, ET AL.

It is certified that error appears in the above-identified patent and that said Letters Patent is hereby corrected as shown below:

COLUMN 6

Line 15, "occurence" should read --occurrence--.
Line 60, "$C_1$," should read --$C_1$--.
Line 66, "total" should read --a total of--.

COLUMN 7

Line 8, "doesn't" should read --does not--.
Line 36, "doesn't" should read --does not--.
Line 44, "it." should read --it--.
Line 45, "selection)" should read --selection).--.

COLUMN 8

Line 5, "doesn't" should read --does not--.
Line 39, "1(4)" should read --(4)--.

COLUMN 9

Line 39, "$CWFD_o$" should read --signals $CWFD_o$--.

UNITED STATES PATENT AND TRADEMARK OFFICE

CERTIFICATE OF CORRECTION

PATENT NO. : 5,898,417

DATED : April 27, 1999

INVENTOR(S): HIDEO KANNO, ET AL.

It is certified that error appears in the above-identified patent and that said Letters Patent is hereby corrected as shown below:

COLUMN 11

Line 2, "memory-296" should read --memory-2 96--.
Line 33, "$SWDF_1$" should read --$SWFD_1$--.
Line 34, "$SWDF_2$" should read --$SWFD_2$.

COLUMN 14

Line 9, "eleotrode" should read --electrode--.

Signed and Sealed this

Eighteenth Day of July, 2000

*Attest:*

Q. TODD DICKINSON

*Attesting Officer*

*Director of Patents and Trademarks*